United States Patent [19]

Genovese

[11] 4,221,941

[45] Sep. 9, 1980

[54] ROCKER SWITCH HAVING IMPROVED CONTACT-OPERATING MEANS

[75] Inventor: John M. Genovese, Trenton, N.J.

[73] Assignee: GTE Sylvania Wiring Devices Incorporated, Trenton, N.J.

[21] Appl. No.: 1,495

[22] Filed: Jan. 8, 1979

[51] Int. Cl.[2] ..... H01H 21/04; H01H 3/00

[52] U.S. Cl. ..... 200/67 A; 200/67 G; 200/339

[58] Field of Search ..... 200/67 R, 67 A, 67 G, 200/68, 315, 339

[56] References Cited

U.S. PATENT DOCUMENTS

| | | | |
|---|---|---|---|
| 1,821,180 | 9/1931 | Gaynor | 200/67 A |
| 2,725,438 | 11/1955 | Bentley | 200/67 A |
| 2,987,592 | 6/1961 | Johnson | 200/67 R |
| 3,250,887 | 5/1966 | Sorenson | 200/167 |
| 3,413,430 | 11/1968 | Sharples | 200/153 |
| 3,535,478 | 10/1970 | Lewis | 200/67 G |
| 3,662,130 | 5/1972 | Bonetalli | 200/67 G |
| 3,670,121 | 6/1972 | Howe | 200/67 G |
| 3,684,847 | 8/1972 | Hoehn et al. | 200/67 A |
| 4,121,072 | 10/1978 | Hults | 200/67 G X |

*Primary Examiner*—Steven M. Pollard

*Attorney, Agent, or Firm*—Frederick A. Zoda; John J. Kane; Albert Sperry

[57] ABSTRACT

A general purpose, alternating current wall switch is provided with a rocker handle having an extremely light feel resulting from the fact that the angular distance or throw between the opposite extreme positions thereof is very small, on the order of about 20 degrees in a preferred embodiment. Throw of the handle through the noted small angular distance is effective, however, to operate a contact actuator through a much larger angular distance to assure a proper mechanical and electrical function, the distance through which the contact actuator rocks in a preferred embodiment being on the order of about 50 degrees. The mechanical advantage is produced by a loose, lost motion interengagement between the rocker handle and the contact actuator, both of which are mounted to rock about spaced, separate pivot axes. The interengagement of the rocker handle and contact actuator results from the provision of a bifurcation on the underside of the rocker handle, loosely embracing a triangular rib or projection on the contact actuator head. Throw of the rocker handle is effective to initially produce a camming engagement of one of the fork arms of the bifurcation against an adjacent surface of the triangular rib. As the rocker handle moves to its opposite extreme position, the contact actuator is cammed over center, and an associated spring means then becomes effective to snap the actuator the remaining distance to its opposite extreme position. As the actuator and the rocker handle move through the remainder of their respective angular distances following passage of the actuator over dead center, they are fully disengaged from each other and there is no interference between them.

13 Claims, 10 Drawing Figures

ROCKER SWITCH HAVING IMPROVED CONTACT-OPERATING MEANS

CROSS REFERENCE TO RELATED APPLICATIONS

The present application is related to contemporaneously filed patent application of Julius F. Tibolla, entitled "IMPROVED MOUNTING MEANS FOR INTERCHANGEABLE SWITCH HANDLES", application Ser. No. 1,496 filed Jan. 8, 1979.

BACKGROUND OF THE INVENTION

1. Field of the Invention

This invention lies in the broad category of those electrical switches known to the trade as AC general use snap switches. In a more particular sense, the invention falls in that category of AC switches normally wall-mounted within domestic or commercial buildings for use on alternating-current circuits for controlling resistive and inductive loads, tungsten-filament lamp loads, and motor loads.

2. Description of the Prior Art

It is very common to provide general purpose AC switches of the character described above, in which one or more elongated contact carrier arms of leaf spring characteristics, are deflected between circuit-closing and -opening positions, by a cam acting against the contact carrier responsive to rocking movement of the switch handle. Most usually, the switch handle is molded integrally with the cam, as for example in the U.S. Pat. No. 2,725,438 to Bentley. Accordingly, if it is found that a throw of perhaps 50 degrees total angular travel is needed for the cam movement, then the handle itself must obviously have the same amount of angular travel.

While this arrangement has been found entirely suitable and adequate when the switch handle is in the form of an elongated, radially outwardly projecting member, in recent years switches having so-called rocker handles have become very popular. A rocker handle, as typically provided in the industry, is most usually in the form of a flat, wide, elongated plate, lying almost flush with the wall plate generally associated with a switch of this type. The rocker handle, however, must desirably be limited to a total angular travel substantially less than that which is permissible and indeed favored for switch handles of the so-called toggle arm type.

Heretofore, it has been proposed to minimize angular travel of the rocker handle while still imparting a relatively long throw to the contact operating cam or equivalent thereof, by extending the contact operating means a substantial depth inwardly of the switch housing, from the axis of rocking movement of the handle. Typical examples of switches having elongated inwardly extending members disposed substantially radially of the axis of rocking movement of the handle, are found in various U.S. Pat. Nos. such as Carling 3,225,153; Sorenson 3,250,887; and Lewis 3,535,478.

It has been proposed, in some of these patents and also in other patents representative of the prior art, to interpose between the rocker handle and the contact carrier, a separate and distinct contact actuator. This is normally mounted for rocking movement about an axis separate from the axis of the rocker handle. The arrangement is typified by such U.S. Pat. Nos. as Mo Goto 3,315,052; the above mentioned Lewis Patent; Howe 3,670,121; and Taylor 2,794,890.

All of these prior art devices, however, have one or more deficiencies, the elimination of which is intended by the present invention. For example, in the prior art the construction is often extremely complicated, so as to be wholly incapable of widespread commercial use, particularly in so highly competitive a field as AC wall switches intended for domestic use. Or, in many instances the desired mechanical advantage resulting from a small angular travel of the rocker handle is not achieved. In other instances, assembly of the parts is complicated, by reason of the fact that the contact mechanism and the actuating means for said mechanism cannot be assembled except simultaneously with the rocker handle itself, an arrangement which is undesirable particularly when it is intended that the switch facilitates the replacement or rocker handles from time to time of decorative purposes.

In still other instances, the prior art has been noted as presenting difficulties in that to assure proper electrical characteristics in the switch, it is important that the switch function electrically without interfering with or being interfered with by the throw of the rocker handle by a user. In AC switches of this type, the most desirable electrical characteristic is to have a slow break and a fast make, and obviously, this must be carried out repetitively throughout the entire length of the switch without being affected by the way in which the rocker handle is thrown by a user. At the same time, it is important that the make or break action take place without imparting an undesirable click or bounce through the operating handle itself.

SUMMARY OF THE INVENTION

The present invention is intended to obviate the several difficulties and deficiencies noted in prior art devices of a similar nature, through the provision of a rocker handle that can be very attractive from a decorative standpoint, in that the rocker handle is capable of being almost flush with a wall plate, and particularly designed to be incorporated into the decorative scheme of the room in which the switch is installed. It is further proposed, in carrying out the invention, that the rocker handle have an extremely light feel, that is, that the rocker handle be designed so as to be capable of being thrown by the user responsive merely to an extremely light tough of the finger. Yet, in carrying out the invention it is proposed that this light touch, and minimal total angular travel of the rocker handle, be designed to impart to the interior mechanism of the switch a full angular travel sufficient to assure, every time, proper electrical performance in respect to the slow-break-fast-make found desirable in AC switches, and further in respect to the efficient operation of the switch, over a long period of time, up to its rated capacity.

To this end, the invention incorporates a switch having an interior contact mechanism which in and of itself is well known, a feature which is indeed desirable in order to permit interchangeability of parts by a manufacturer so that switches can be made either with rocker handles or with the more conventional elongated toggle handles, all with the same interior contact carriers, terminals, and housing designs.

In association with a contact carrier mechanism of the known type found, for example, in the above mentioned Bentley Patent and also found in such U.S. Pat. Nos. as Ulrich 3,290,465 and Slater 2,795,677, it is proposed to utilize a rockable contact actuator having the usual contact carrier deflection cam or cams, and mounted for rocking movement in the housing about the same pivot axis as normally used for conventional toggle type handles. The rockable actuator, when assembled with the housing, mounting strap, and contact mechanism, becomes with these components a self-contained switch, and the subsequent assembly of a rocker handle in association therewith can be carried out whenever desired, even by a homeowner who may desire, from time to time, to interchange rocker handles for the purpose of blending them in with new room decors. A typical arrangement permitting replaceable handles is noted, thus, in the application of Julius F. Tibolla, filed concurrently herewith.

A lost motion interengagement is provided between the rocker handle and the contact actuator, such that the mounting of the rocker handle in bearings provided upon the mounting strap of the switch, is effective to interengage the rocker handle and actuator for rocking of the actuator through an angular distance on the order of, preferably, about 2 and ½ times that of the rocker handle itself. The rocker handle, when normally operated by a user, merely biases the contact actuator over dead center, and a control spring for the actuator then acts to rock the actuator through the remainder of its total angular travel. Both the rocker handle and the actuator move through the rest of their travel, without interfering with each other, an important feature of the invention by reason of the need for assuring proper electrical operation within the switch, as well as assuring against imparting an undesirable click or bounce to the rocker handle exteriorly of the housing.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENTS

In FIGS. 1–8, for purposes of illustrating and describing a typical construction there has been disclosed a single-pole, single-throw switch. This is the most common variety of switch, but it will be understood that the invention is intended to apply equally well to the other typical switches normally installed in residential and commercial buildings to control lighting and other loads of the kinds referred to briefly above. Other typical switches, thus, would be three-way switches, four-way switches, and single-pole, double-throw switches adapted to break both sides of a circuit.

In any event, in the illustrated example the switch comprising the present invention has been generally designated 10, and includes a housing 12 having a body 13 and cover 14 of molded plastic or other electrically insulative material.

Figure 3:
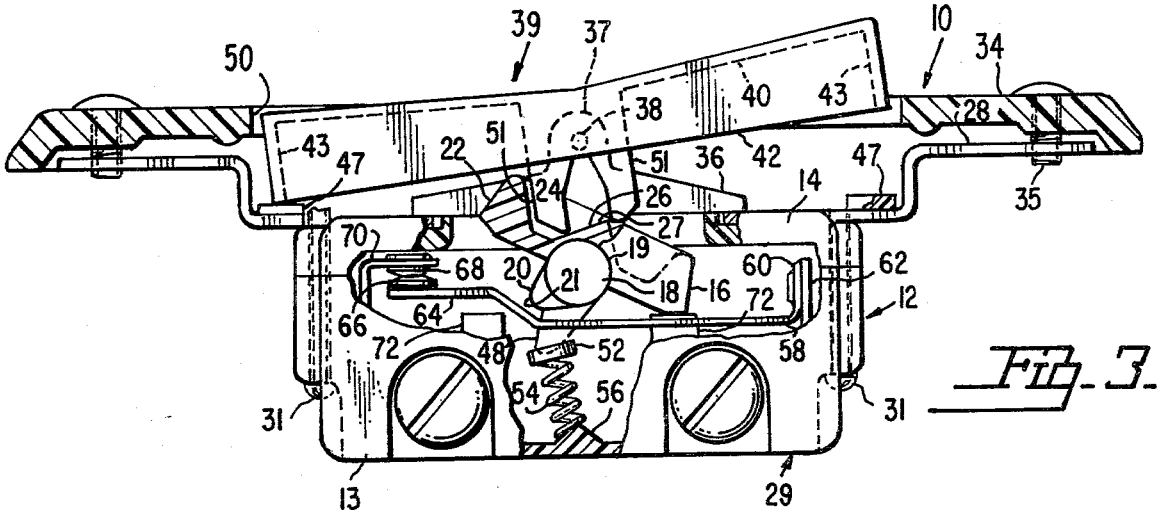
FIG. 3 is a view of a single-pole, single-throw switch according to the present invention, with the contacts in closed position, the switch being shown partly in side elevation and partly in longitudinal section, portions being broken away.
Figure 7:
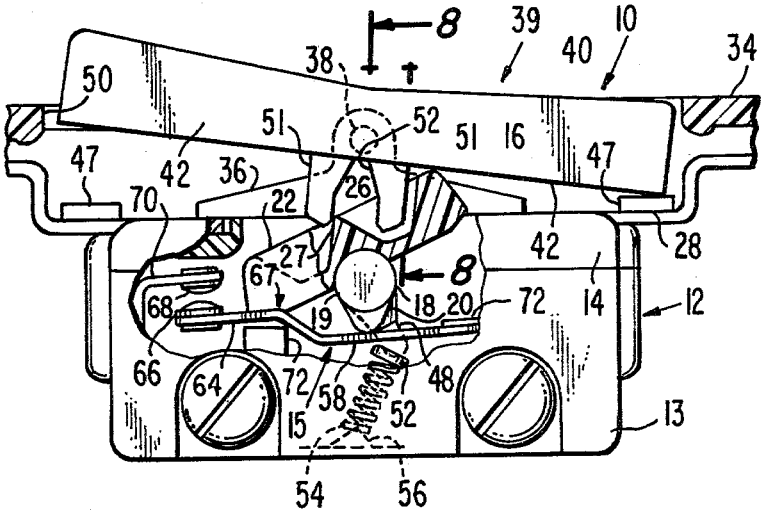
FIG. 7 is a view like FIG. 3, showing the switch operated fully to its opposite extreme position with the contacts fully open.

Within the housing, there is provided a mechanism generally designated 15 including a cam actuator 16 of molded plastic material, molded integrally with a pivot shaft 18 which extends transversely of the housing, and is provided at its ends with trunnions 9 adapted to bear in complementary bearing recesses formed in the housing and cover, to mount the cam actuator for rocking movement between the opposite extreme positions shown in FIGS. 3 and 7 respectively. The actuator, as may be noted, rocks between its opposite extreme positions through a total angular distance on the order of about 50 degrees, on the axis defined by the pivot shaft 18.

Molded integrally with the pivot shaft 18 is a cam means 20. The cam means 20 is in the form of a relatively short member extending radially from the axis of the pivot shaft 18, and tapering in a direction away from the shaft. The cam means 20, at its outer end, has a rounded cam surface 21.

Figure 9:
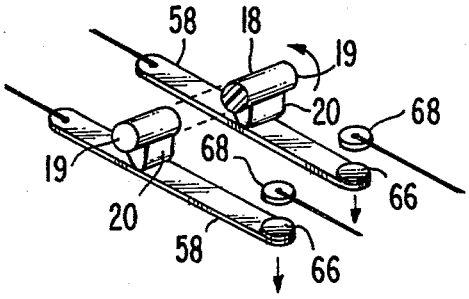
FIG. 9 is a schematic illustration showing the contact and cam arrangement preferred for a double-throw, single-pole switch adapted to break both sides of a circuit.

The cam means may include a single cam, upon one of the trunnions, when the switch is to be assembled and used as a single-pole, single-throw switch. Alternatively, and more usually, the cam means will be duplicated at both ends of the shaft 18, in the manner shown schematically in FIG. 9.

The arrangement so far illustrated and described, as to the pivot shaft and cam means, is well known in and of itself in the art, and may be seen, for example, in such prior art U.S. Pat. Nos. as Bentley 2,725,438, Pollack 3,497,646, and Ehrlich et al. 3,030,479. In these patents, however, the cam means travels an angular distance which is the same as that of the handle employed for rocking the shaft 18 through said distance, that is, the handle, shaft, and cam means all rotate as one about the axis of the pivot shaft.

In accordance with the present invention, the prior art arrangement is not used and instead, the cam means is molded integrally with a generally rectangular, substantially flat head 22. The head 22 is molded integrally with the shaft, medially between the opposite ends of the shaft, and the shaft axis extends transversely of the head in the plane of the underside of the head (see FIG. 3), medially between the opposite ends of the head.

In the upper or outer surface of the head, there are formed end recesses 24, disposed at opposite sides of a triangular transversely extending rib or projection 26. The provision of the transverse projection 26 defines cam surfaces 27, said cam surfaces being the opposite sides of the rib and converging in a direction outwardly of the housing in order to impart to the transverse rib or projection the triangular cross sectional shape seen to best advantage in FIGS. 3–7.

Overyling the cover 14 is an elongated, metal mounting strap 28, the ends of which project beyond the housing for the purpose of attachment to an outlet box, not shown. Assembly screws 31 extend through registering openings of the body 13 and cover 14 (see FIG. 3) and are threadedly engaged in openings of the strap, to hold the strap, cover, and body assembled with each other, thus defining a housing assembly generally designated 29 and comprising the body, cover, and strap.

Figure 1:
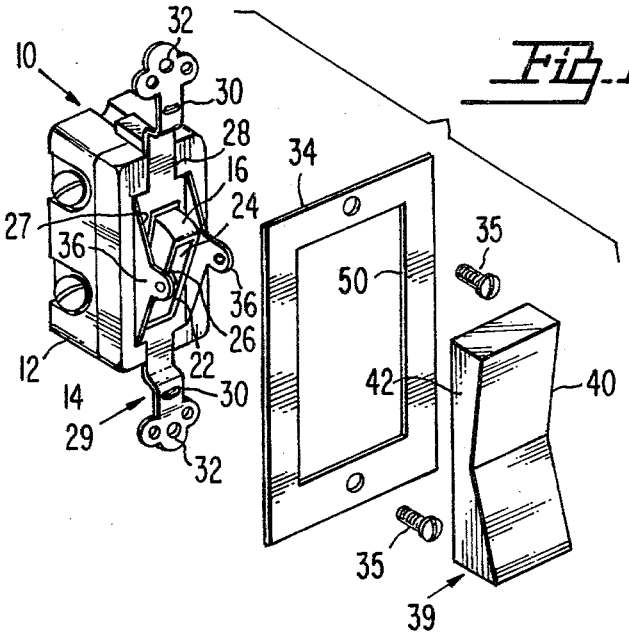
FIG. 1 is an exploded perspective view of a switch constructed according to the present invention, as it appears prior to attachment of the wall plate and the rocker handle.

Referring to FIG. 1, the opposite ends of the strap are offset in a manner conventional in wall switches of this type, and are formed with openings or slots 30 adapted to receive mounting screws (not shown) whereby the switch may be installed in an outlet box, also not shown. Also provided in the offset ends of the strap are threaded openings 32, registering with openings 33 of wall plate 34, to receive screws 35 adapted for mounting the wall plate over the outlet box after installation of the switch.

In accordance with the present invention, the strap is formed with outwardly projecting, transversely spaced bearing plates 36, which in the present instance are in the form of low, generally triangular flanges integrally formed upon the opposite sides of the strap medially between the opposite ends of the strap, adjacent the rockable head 22 of the cam actuator 16. The cam actuator, as will be noted, lies in an opening formed in the cover, so that its recesses 24 and transverse rib 26 project outwardly (see FIG. 1). The bearing plates 36 are formed with transversely aligned, rounded ears 37 having inwardly projecting, shallowly conical bearing projections 38 (see FIG. 8) on which is rockably supported the rocker handle generally designated 39.

The rocker handle 39 can be snapped into position upon the bearing projections 38, and in some instances may be formed with means for preventing it from being detached from the bearing projections after the wall plate is installed, as disclosed in the above mentioned Tibolla application. However, so far as the present invention is concerned, the anti-removal means of the Tibolla application is not essential, it being mainly important that the rocker handle be supported for rocking movement between the opposite extreme positions shown in FIGS. 3 and 7 respectively, in a loosely interengaged relationship with the head 22 of the actuator 16.

Figure 2:
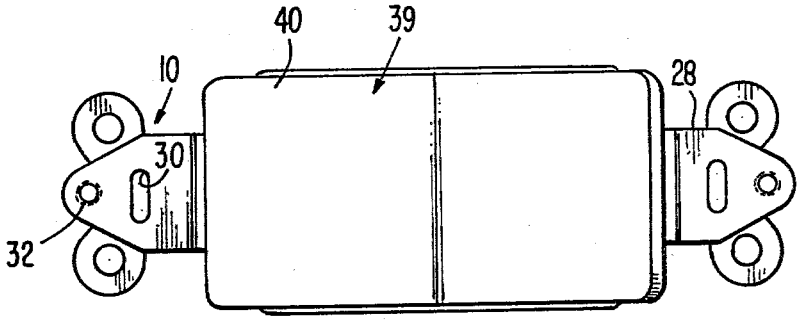
FIG. 2 is a top plan view of the switch constructed according to the present invention, on a scale enlarged above that of FIG. 1.

The rocker handle is of molded plastic in a preferred embodiment, and is, when viewed in plan, of large, rectangular configuration, overlying the entire switch housing assembly (see FIG. 2). Handle 39, in the illustrated example, has a handle plate or body 40 which may as shown have its opposite end portions disposed in planes that are at a shallow obtuse angle to each other (see FIG. 3). In any event, in the illustrated example the plate 40 is integrally formed at its opposite ends with inwardly extending end walls 43, and is also formed over its full length with correspondingly inwardly extending side walls 42.

Figure 8:
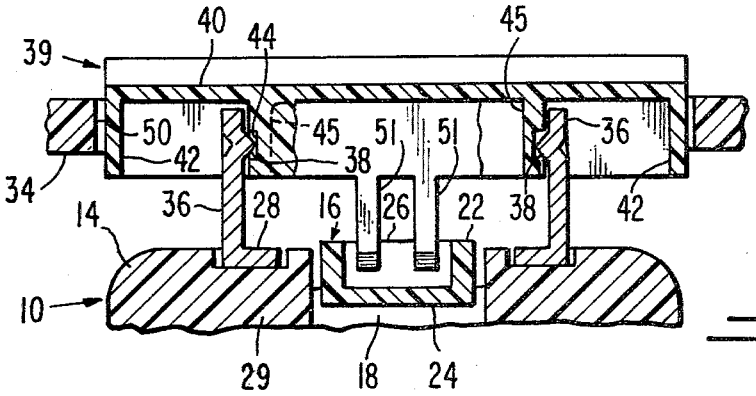
FIG. 8 is a transverse sectional view substantially on line 8—8 of FIG. 7.

Referring to FIGS. 3 and 8, the underside of handle 39 is molded integrally, intermediate its ends, with transversely spaced bearing partitions 45, having outwardly facing bearing recesses 44 adapted to receive the bearing projections 38, for the purpose of mounting the handle for rocking movement between the opposite extreme positions thereof shown in FIGS. 3 and 7. The handle rocks through a total angular distance of about 20 degrees. In this connection, the detailed construction of the handle is not illustrated or described herein, since the handle has been fully illustrated and described in the above mentioned co-pending Tibolla application, which illustration and description is incorporated by reference herein. It is sufficient to note, for the purposes of the present application, that the handle is adapted to respond to a gentle touch exerted thereagainst by a user, for the purpose of imparting the desired rocking motion between its extreme positions, through the small total angular travel required by the inventive construction.

For the purpose of damping the sound of the switch operation to the maximum extent, and also for the purpose of enhancing the "feel" of the needle operation, it is preferred to utilize low, soft rubber bumpers 47, adhesively secured to the strap in position to engage the end walls 43 of the handle (see FIG. 3) during the rocking motion imparted to the handle by a user.

The handle is adapted to fit within a large, rectangular, center opening 50 of the wall plate, and when the wall plate is installed over the switch, a small clearance is provided at the sides and ends of the rocker handle, which clearance is held to a minimum while still assuring free operation of the handle without contact with the wall plate.

Means is incorporated in the handle for loosely embracing the triangular projection 26 of the actuator 16. Said means is in the form of a bifurcation defined by fork arms 51, which as shown in FIG. 3 loosely embrace the triangular tip of the projection 26. The fork arms 51 are arranged in transversely spaced pairs (see FIG. 8), although this is not critical to the invention, it being sufficient that there be a single pair of fork arms. In the illustated example, however, the fork arms 51 shown at the right in FIG. 3 are received in one recess 24 of head 22, while the fork arms 51 appearing at the left in FIG. 3 are disposed within the left and recess 24 of the actuator head.

The triangular projection 26, and the fork arms 51, cooperate to define a means on the rocker handle and the cam actuator interengaging loosely to impart rocking motion to the actuator responsive to rocking of the handle between its opposite extreme positions by a user. In this connection, there is also provided, for cooperating with the fork arms 51 in rocking the actuator between its extreme positions, an over-center spring means comprising a compression coil spring 54 having one end engaged with a molded seat 56 of body 13, and having a shallowly depressed cap 52 at its other end adapted to receive finger 48 molded integrally with the shaft 18 medially between the opposite ends of the shaft.

The over-center spring means and the finger 48, like the shaft 18 and the cam means 20, are per se conventional, and are shown by way of example in the above mentioned Bentley U.S. Pat. No. 2,725,438. Also basically conventional and disclosed in patents such as the Bentley patent and the above mentioned Slater patent, is a contact carrier or support arm 58, formed as an elongated length of electrically conductive, leaf spring material, one end of which is extended upwardly (see FIG. 3) as at 60 and is riveted or otherwise fixedly anchored to an upstanding terminal plate 62. The distal end of the contact carrier 58 is offset upwardly as at 64, and is provided with a contact 66. Arm 58, having the upwardly offset end 64, and contact 66 cooperate to define a movable contact element, adapted to be deflected between the normal position thereof shown in FIG. 3, and an opposite extreme or deflected position shown in FIG. 7.

The movable contact element is adapted to be shifted into and out of engagement with a stationary contact element, defined by a stationary contact 68 disposed in confronting relation to the contact 66. Contact 68 is affixed to the distal end of a stationary contact carrier or terminal plate 70.

In the illustrated example, a single-pole single-throw switch has been disclosed in FIGS. 1–8, and in this arrangement, there would be provided a single movable arm 58, disposed along one side of the housing, that is, at one side of the over-center spring means, which is centered in the housing. If, however, it is desired to assemble the switch in some other type of electrical configuration, as for example, a single-throw, double-pole switch of the type shown in FIG. 9, there would be a cam means at both ends of the shaft 18, with identical, transversely spaced movable contact carriers 58 underlying the respective cam means. In this arrangement, the cams 20 at both ends of the shaft would be in exact alignment with each other, so that when the actuator is rocked to one extreme position, both cam means would move as one, to either deflect their movable carriers 58 to their lower positions, or alternatively to permit the carriers 58 to return under the inherent spring tension thereof, to their normal upper positions shown in FIG. 3 wherein the contacts 66, 68 are in engagement to close a circuit through the stationary and movable contact elements. The FIG. 9 arrangement may be desired where it is desired to break both sides of a circuit.

In this arrangement, there would be two stationary contact elements, physically and electrically separated from each other, and the same physical and electrical separation would be provided for the movable contact carriers, in an arrangement well known in the art.

Figure 10:
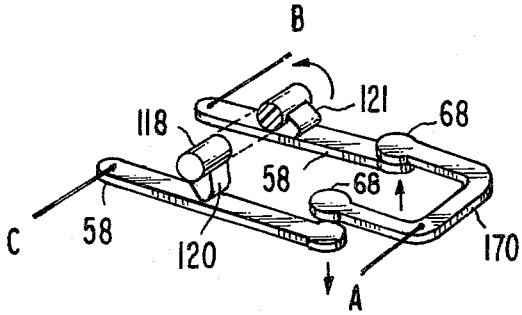
FIG. 10 is a schematic representation showing a modified arrangement utilized for a three-way switch.

In FIG. 10, the invention has been illustrated as it would appear in a typical three-way switch. In this arrangement, the pivot shaft has been designated 118, and would have a first cam 120 offset angularly from a second cam 121, such that when the actuator is rocked to the FIG. 7 position thereof, the cam 120 would bias its contact carrier 58 downwardly to the FIG. 7 position, while the cam 121 at the opposite end of shaft 118 would be disposed wholly out of engagement with its associated arm 58. In this case, the stationary contact elements 68 are joined by a bridging plate 170, in the typical three-way switch arrangement. In such an arrangement, in one extreme position of the operating handle, line A is connected with line B and is disconnected from line C. In the opposite extreme position of the handle, line A is disconnected from line B, and is connected to line C.

These arrangements are quite typical, and are illustrated merely to show the preferred type of double-pole and three-way configurations. The arrangements are identical to those referred to and described in Slater U.S. Pat. No. 3,173,031 (column 3, lines 57–75; and column 4, lines 1–5).

While the particular embodiments of this invention have been shown in the drawings and described above, it will be apparent that many changes may be made in the form, arrangement and positioning of the various elements of the combination. In consideration thereof is should be understood that preferred embodiments of this invention disclosed herein are intended to be illustrative only and not intended to limit the scope of the invention.

OPERATION

In use of the invention, let it be assumed that the switch has been assembled as a single-pole, single-throw switch and that the switch is in the closed position shown in FIG. 3. The user, in operating the switch to open position, merely exerts a light pressure against the right hand end of the handle 39, viewing the same as in FIG. 3. This pressure is translated into a camming pressure exerted by the distal end of the fork arm 51 seen at the right in FIG. 3, said fork arm exerting a light pressure against the tip portion of the triangular projection 26 of the cam actuator.

Figure 4:
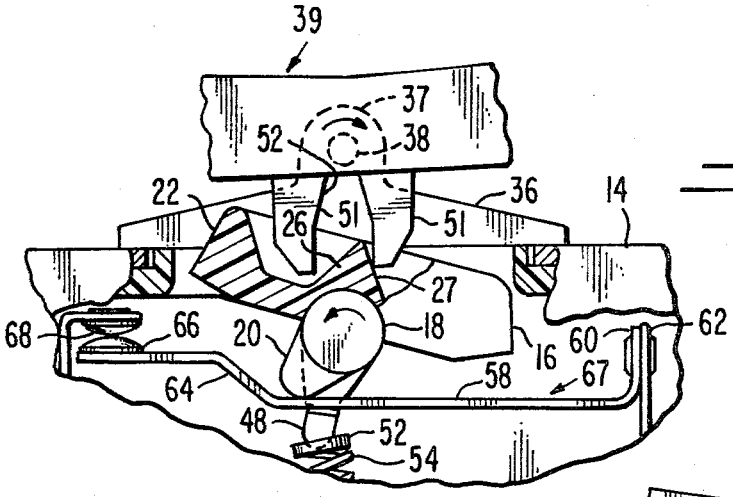
FIGS. 4–6 are fragmentary views, partly in longitudinal section, showing the parts of the switch as they appear at successively following stages during operation from the contact-closing position of FIG. 3.
Figure 5:
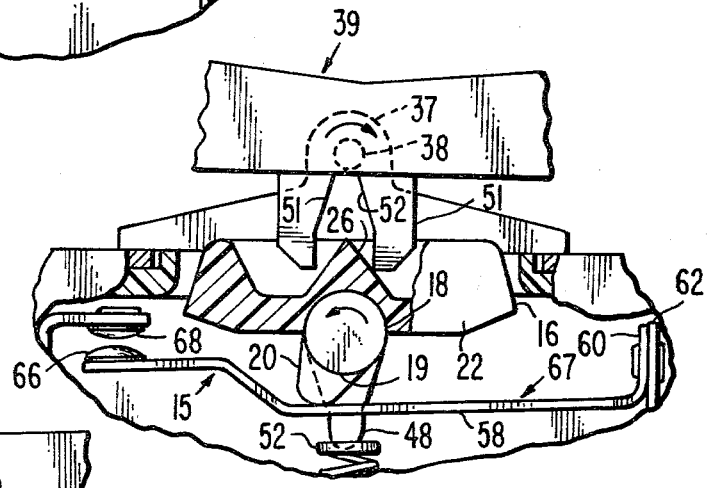
Figure 6:
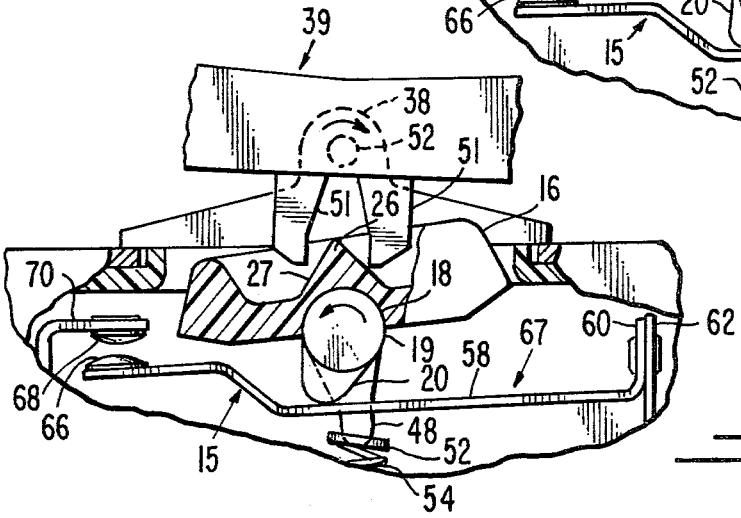

As the rocker handle begins to move to its opposite extreme position, under the finger pressure exerted by the user, it moves through the positions shown in FIGS. 4–6 respectively. In FIG. 4, it is seen that the rocker handle has been moved from its FIG. 3 position to an extent such as to initiate rocking movement to the actuator 16 in a counter-clockwise direction about its pivot axis defined by the shaft 18. Cam 20 has moved into engagement with carrier 58, but so far, has not shifted the carrier downwardly, as a result of which the contacts 66 and 68 are still in engagement.

Continued movement of the rocker handle 39 in the clockwise direction will, as shown in FIG. 5, cause the cam actuator head to shift to a dead center position shown in FIG. 5, in which the finger 48 and the spring 52 are in direct coaxial alignment, and in which, further, carrier 58 has been biased to a position in which contacts 66 and 68 have separated. This is the desirable "slow break" characteristic of efficiently operating AC switches of this type.

Continued clockwise movement of the rocker handle 39 causes a continuing cam action to be exerted by the right hand fork arm 51 against the confronting, right hand cam surface 27 of projection 26. As a result, the head 16 has now moved over-center in a counter-clockwise direction. Immediately, spring 54, tending to expand, takes over the function of snapping the head to its opposite extreme position shown in FIG. 7, in which cam 20 is now disposed vertically, and in which the contacts 66 and 68 have been separated to their maximum extent.

Once the actuator has moved past dead center, that is, from its FIG. 5 to its FIG. 6 positions, the projection 26 and the bifurcation of the handle 39 become fully disengaged, and the final movement of the rocket handle to its FIG. 7 position, through a total angular travel of about 20 degrees, does not interfere with the final movement of the actuator to its final position also shown in FIG. 7, since the bifurcation receives the triangular projection very loosely, and there is thus a full clearance between the projection and the bifuraction during the portion of the actuator travel in which it moves under the force of the spring 54. This is highly desirable, to prevent the rocker handle from being given a "click" or bounce while the user's finger pressure is still exerted thereagainst. It is further desirable to prevent the rocker handle from interfering with the free movement of the actuator fully to the FIG. 7 extreme position thereof.

The rocker handle, in the illustrated embodiment, has a total angular travel of about 20 degrees. Yet, the actuator moves through approximately 50 degrees, an angular distance which is important for the purpose of assuring good electrical functioning of the switch. Such assurance is essential, since switches of this type must meet standards established by Underwriters Laboratories, else they cannot be effectively merchandised commercially.

When the switch is operated from a circuit-opening to a circuit-closing position, that is, when the switch is in its FIG. 7 position and is to be operated to its FIG. 3 position, exertion of a pressure against the rocker handle at the left hand end thereof (viewing the same as in FIG. 7) causes the cam action to be exerted by the left fork arm 51. Again, the actuator moves over-center, and snaps fully to the FIG. 3 position by reason of the inherent spring tension in the contact carrier 58, which is allowed to assert itself by reason of the movement of the cam 20 fully out of engagement with the carrier under the force resulting from the expansion of the compression coil spring 54. Again, there is not interference between the actuator and the handle, as they move to their opposite extreme positions after the actuator moves across dead center.

An important advantage in the switch is found in the fact that the entire mechanism, including the actuator, is assembled separately from the handle itself, so that the handle can be attached later, when the switch is actually installed in the residence or commercial establishment. Because of this feature, it is possible to assemble with the switch any of various decorator type handles, the colors of which are selected according to the room decor. The handles and wall plates, thus, can be matched or harmonized, depending upon the surroundings, and once the handle is snapped into place, it will automatically be in operative relationship to the actuator, and will produce the mechanical advantage previously described herein, during the relatively small angular distance over which the handle rocks between its opposite extreme positions.

I claim:

1. In an electrical switch of the alternating-current type that includes a housing, at least one stationary contact element therein, at least one contact element mounted in the housing for movement between make and break positions in one of which it contacts and in the other is spaced from the stationary element, one end of the movable contact element being anchored in the housing and the other being free to move into and out of engagement with the stationary contact element, rockable actuator means of electrically insulative material mounted in the housing assembly for rocking movement about an unchanging axis extending transversely of the housing through a predetermined first angular distance between opposite extreme positions, a cam connected to the actuator means for rocking movement therewith and adapted to bias the movable contact element to at least the contact-breaking position of the movable contact element in response to rocking of the actuator means from one toward the opposite extreme position thereof, and over-center spring means in the housing for biasing the actuator means about its pivot axis to its respective opposite extreme positions, the housing having a stationary spring seat for one end of the spring and the actuator means having a finger rockable with the actuator about the pivot axis thereof and movable across a dead center occurring between the opposite extreme positions of the actuator means, the improvement comprising:

(a) rockable handle means mounted on the housing to rock about an unchanging axis parallel to and spaced from that of the actuator means through a second angular distance less than said first angular distance; and (b) means on the handle and actuator means respectively movable into camming engagement with each other for biasing the actuator means, responsive to rocking of the handle means through said second angular distance, from said one of the extreme positions of the actuator means over-center to an intermediate position thereof in which the spring means becomes effective to bias the actuator means the remaining distance to its opposite extreme position.

2. In an electrical switch the improvement of claim 1 wherein said last named means biases the actuator means to its intermediate position responsive to rocking of the handle means through approximately half said second angular distance.

3. In an electrical switch the improvement of claim 1 wherein said last named means of the handle and actuator means are arranged to define a lost motion interengagement of said handle and actuator means with each other such that they are disengaged for at least a substantial portion of the travel of the actuator means between said extreme positions thereof.

4. In an electrical switch the improvement of claim 1 wherein the means interengaging between the handle and wherein the means interengaging between the handle and actuator means become wholly disengaged responsive to the spring moving over dead center and becoming effective to bias the actuator means over said remaining angular distance.

5. In a electrical switch the improvement of claim 1 wherein said last named means comprises a tongue on one of the rockable means, the other rockable means having a recess in which the tongue is loosely received, the tongue having cam surfaces at opposite sides thereof and the recess having walls defining cam surfaces engageable by the respective cam surfaces of the tongue.

6. In an electrical switch the improvement of claim 1 wherein one of the actuator means has a bifurcation, and the other rockable means includes a tongue loosely embraced by said bifurcation, said tongue having opposite cam surfaces presenting themselves to corresponding opposite walls of the bifurcation, whereby on rocking of the handle means in one direction, one wall of the bifurcation will exert a cam action against one cam surface of the tongue, and on rocking of the handle means in an opposite direction the other wall of the bifurcation will exert a cam action against the opposite cam surface of the tongue.

7. In an electrical switch of the type that includes a housing assembly, at least one stationary contact element therein, at least one contact element mounted in the housing for movement between first and second positions in one of which it contacts and in the other is spaced from the stationary element, rockable actuator means mounted in the housing assembly for rocking movement through a pre-determined first angular distance between opposite extreme positions, a cam connected to the actuator means for rocking movement therewith and adapted to bias the movable contact element to at least one of said positions of the movable contact element in response to rocking of the actuator means to an extreme position thereof, and over-center spring means in the housing for biasing the actuator means about its pivot axis to its respective opposite extreme positions, the improvement comprising:

(a) rockable handle means mounted on the housing assembly to rock about an axis spaced from that of the actuator means through a second angular distance less than said first angular distance; and (b) means on the handle and actuator means respectively for biasing the actuator means, responsive to rocking of the handle means, from one of the extreme positions of the actuator means over-center to an intermediate position thereof in which the spring means becomes effective to bias the actuator means the remaining distance to its opposite extreme position, said last-named means comprising an approximately triangular projection on one of the rockable means and fork arms carried by the other rockable means in embracing relation to said projection, said projection presenting convergent, opposite cam surfaces to the respective fork arms, one of said fork arms cammingly engaging one of said cam surfaces of the projection on rocking of the handle means in one direction, and the other fork arm cammingly engaging the opposite cam surface of the projection on rocking of the handle means in an opposite direction.

8. In an electrical switch of the type that includes a housing assembly, at least one stationary contact element therein, at least one contact element mounted in the housing for movement between first and second positions in one of which it contacts and in the other is spaced from the stationary element, rockable actuator means mounted in the housing assembly for rocking movement through a pre-determined first angular distance between opposite extreme positions, a cam connected to the actuator means for rocking movement therewith and adapted to bias the movable contact element to at least one of said positions of the movable contact element in response to rocking of the actuator means to an extreme position thereof, and over-center spring means in the housing for biasing the actuator means about its pivot axis to its respective opposite extreme positions, the improvement comprising:

(a) rockable handle means mounted on the housing assembly to rock about an axis spaced from that of the actuator means through a second angular distance less than said first angular distance; and (b) means on the handle and actuator means respectively for biasing the actuator means, responsive to rocking of the handle means, from one of the extreme positions of the actuator means overcenter to an intermediate position thereof in which the spring means becomes effective to bias the actuator means the remaining distance to its opposite extreme position, said actuator means including an elongated head formed intermediate its ends with a triangular projection and having recesses disposed at opposite sides of said projection, the handle means including a pair of fork arms extending into the respective recesses of said head in embracing relation to the projection, said projection presenting convergent cam surfaces to the respective fork arms, for engagement of one of said cam surfaces by one fork arm responsive to rocking of the handle means in one direction, and for engagement of the opposite cam surface by the other fork arm in response to rocking of the handle means in the opposite direction.

9. In an electrical switch the improvement of claim 8 wherein the fork arms are spaced apart a distance such that said projection moves wholly clear of both fork arms during travel of the actuator means from said intermediate position to said opposite extreme position thereof simultaneously with movement of the handle means through the full extent of its angular travel.

10. In an electrical switch of the type that includes a housing assembly, at least one stationary contact element therein, at least one contact element mounted in the housing for movement between first and second positions in one of which it contacts and and in the other is spaced from the stationary element, rockable actuator means mounted in the housing assembly for rocking movement through a pre-determined first angular distance between opposite extreme positions, a cam connected to the actuator means for rocking movement therewith and adapted to bias the movable contact element to at least one of said positions of the movable contact element in response to rocking of the actuator means to an extreme position thereof, and over-center spring means in the housing for biasing the actuator means about its pivot axis to its respective opposite extreme positions, the improvement comprising:

(a) rockable handle means mounted on the housing assembly to rock about an axis spaced from that of the actuator means through a second angular distance less than said first angular distance; and (b) means on the handle and actuator means respectively for biasing the actuator means, responsive to rocking of the handle means, from one of the extreme positions of the actuator means over-center to an intermediate position thereof in which the spring means becomes effective to bias the actuator means the remaining distance to its opposite extreme position, the first angular distance being on the order of twice the second angular distance.

11. In an electrical switch the improvement of claim 10 wherein the first angular distance is at least twice that of the second angular distance.

12. In an electrical switch the improvement of claim 10 wherein he first angular distance is on the order of approximately 50 degrees.

13. In an electrical switch of the type that includes a housing assembly, at least one stationary contact element therein, at least one contact element mounted in the housing for movement between first and second positions in one of which it contacts and in the other is spaced from the stationary element, rockable actuator means mounted in the housing assembly for rocking movement through a pre-determined first angular distance between opposite extreme positions, a cam connected to the actuator means for rocking movement therewith and adapted to bias the movable contact element to at least one of said positions of the movable contact element in response to rocking of the actuator means to an extreme position thereof, and over-center spring means in the housing for biasing the actuator means about its pivot axis to its respective opposite extreme positions, the improvement comprising:

(a) rockable handle means mounted on the housing assembly to rock about an axis spaced from that of the actuator means through a second angular distance less than said first angular distance; and (b) means on the handle and actuator means respectively for biasing the actuator means, responsive to rocking of the handle means, from one of the extreme positions of the actuator means over-center to an intermediate position thereof in which the spring means becomes effective to bias the actuator means the remaining distance to its opposite extreme position, said last named means comprising a pair of fork arms extending inwardly of the housing assembly from the handle means at a location between the pivot axes of the handle means and actuator means, the actuator means including a head formed with an approximately triangular projection extending toward and loosely embraced by the fork arms, said head having recesses at opposite sides of the projection loosely receiving the respective fork arms, said projection presenting a pair of opposite cam surfaces converging in a direction toward the pivot axis of the handle means, and adapted to be engaged by the respective fork arms responsive to rocking of the handle means through said second angular distance, each cam surface being engaged by its adjacent associated fork arm during travel of the handle means through approximately half the second angular distance to rock the actuator means from one of its extreme opposite positions to said over-center intermediate position, the spring means biasing the actuator means the remaining distance to its other extreme position with the fork arms spaced apart at a distance sufficient to move clear of the projection during the travel of the actuator means over said remaining distance.

* * * * *

UNITED STATES PATENT AND TRADEMARK OFFICE

CERTIFICATE OF CORRECTION

PATENT NO. : 4,221,941

DATED : September 9, 1980

INVENTOR(S) : John M. Genovese

It is certified that error appears in the above-identified patent and that said Letters Patent are hereby corrected as shown below:

Column 2, Line 18, change "facilitates" to -- facilitate --

Column 2, Line 18, change "or" to -- of --

Column 2, Line 19, change "of" to -- for --

Column 4, Line 24, change "9" to -- 19 --

Column 6, Line 15, change "needle" to -- handle --

Column 6, Line 38, change "and" to -- hand --

Column 9, Line 15, change "not" to -- no --

Column 12, Line 37, change "he" to -- the --

Signed and Sealed this

*Third* Day of *March 1981*

[SEAL]

*Attest:*

RENE D. TEGTMEYER

*Attesting Officer*

*Acting Commissioner of Patents and Trademarks*